United States Patent [19]

Degner

[11] Patent Number: 4,588,482

[45] Date of Patent: May 13, 1986

[54] PREPARATION OF PHTHALALDEHYDE ACETALS

[75] Inventor: Dieter Degner, Dannstadt-Schauernheim, Fed. Rep. of Germany

[73] Assignee: BASF Aktiengesellschaft, Ludwigshafen, Fed. Rep. of Germany

[21] Appl. No.: 743,091

[22] Filed: Jun. 10, 1985

[51] Int. Cl.[4] ..... C25B 3/02

[52] U.S. Cl. ..... 204/59 R

[58] Field of Search ..... 204/59 R

[56] References Cited

U.S. PATENT DOCUMENTS 4,284,825 8/1981 Degner et al. ..... 204/59 R

FOREIGN PATENT DOCUMENTS 3108790 9/1982 Fed. Rep. of Germany .... 204/59 R

OTHER PUBLICATIONS

J. Chem. Soc. Perkin II, 1975, p. 1656.

J. Chem. Soc. 1950, pp. 2141–2145.

*Primary Examiner*—R. L. Andrews

*Attorney, Agent, or Firm*—John H. Shurtleff

[57] ABSTRACT

Phthalaldehyde acetals of the formula

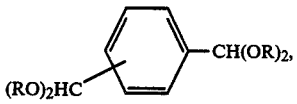

I where R is alkyl, are prepared by a process in which the corresponding bis-(alkoxymethyl)-benzenes are electrochemically oxidized in the presence of an alkanol of the formula ROH.

4 Claims, No Drawings

PREPARATION OF PHTHALALDEHYDE ACETALS

The present invention relates to a novel electrochemical process for the preparation of phthalaldehyde acetals.

Phthalaldehyde acetals can be prepared by, for example, reacting a phthalaldehyde with an o-ester (J. Chem. Soc. Perkin II, 1975, 1656). The phthalaldehydes required as starting materials are prepared, for example, by the Sommelet process from bis-(chloromethyl)-benzenes and hexamethylenetetramine. This process, which is described in, for example, J. Chem. Soc. 1950, 2141–2145, gives only moderate yields and causes pollution. German Laid-Open Application DOS No. 3,108,790 discloses a process for the preparation of phthalaldehyde acetals in which an $\alpha,\alpha,\alpha',\alpha'$-tetrahaloxylane is reacted with an alkali metal alcoholate. The disadvantage of this synthesis is that the tetrahaloxylenes are difficult to obtain, being produced in the halogenation of xylenes only with poor selectivities, in a mixture with xylenes exhibiting various degrees of halogenation.

We have found that phthalaldehyde acetals of the general formula I

I

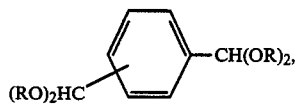

where R is alkyl of 1 to 4 carbon atoms, can advantageously be prepared by a method in which an alkoxymethylbenzene of the general formula

II

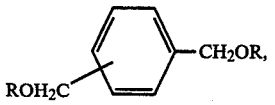

is electrochemically oxidized in the presence of an alkanol of the formula ROH, where R has the above meaning. It is particularly surprising that, in the process of the invention, the oxidation state of the dialdehyde can be attained in a controlled manner with high selectivity.

Examples of alkoxymethylbenzenes of the formula II are 1,2-, 1,3- and 1,4-bis-(methoxymethyl)-benzene, 1,2-, 1,3- and 1,4-bis-(ethoxymethyl)-benzene, 1,2-, 1,3- and 1,4-bis-(propoxymethyl)-benzene, 1,2-, 1,3- and 1,4-bis-(isopropoxymethyl)-benzene and 1,2-, 1,3- and 1,4-bis-(tert.-butoxymethyl)-benzene. Examples of alcohols of the formula ROH are methanol, ethanol, propanol and butanol.

The electrochemical oxidation according to the invention can be carried out in conventional industrial electrolysis cells, unpartitioned flow-through cells being particularly useful. Advantageously, the electrolyte used is a solution of the bis-(alkoxymethyl)-benzene of the formula II in the alkanol. To improve the conductivity, this solution can contain an auxiliary electrolyte, examples of these being bases, such as alkali metal alcoholates, neutral salts, such as fluorides, tetrafluoborates, sulfonates and sulfates, and acids, such as arylsulfonic acids, alkanesulfonic acids and sulfuric acid. Neutral auxiliary electrolytes, such as KF or $KSO_3C_6H_5$, or acidic auxiliary electrolytes, such as $H_2SO_4$, $CH_3SO_3H$ or $C_6H_5SO_3H$, are preferably employed.

The electrolyte has, for example, the following composition:

from 2 to 30% by weight of a bis-(alkoxymethyl)-benzene, from 65 to 98% by weight of an alkanol and from 0.1 to 5% by weight of an auxiliary electrolyte.

In the electrolysis according to the invention, the anode employed consists of, for example, a noble metal, a metal oxide, such as $RuO_2$ or $PbO_2$, or graphite, the last-mentioned substance being the preferred anode material. Examples of suitable cathode materials are steel, iron, nickel, lead and graphite. The current density is from 0.1 to 20, preferably from 2 to 8, A/dm$^2$. If the electrolysis is carried out under atmospheric pressure, advantageous temperatures are not less than 5° C. below the boiling point of the alkanol used, electrolysis being effected, for example, at from −5° to 55° C., preferably from 10° to 50° C. The electrolysis is carried out using from 4 to 12 F per mole of bis-(alkoxymethyl)-benzene. Preferably, electrolysis is effected with 7–10 F per mole of bis-(alkoxymethyl)-benzene, so that the latter is substantially converted. Electrolysis may be effected by a batchwise or continuous procedure.

The mixtures obtained from the electrolysis procedure are preferably worked up by distillation. Unreacted alkanol can be recycled to the electrolysis, without purification. Even when the electrolyte is reused several times, no deactivation or corrosion of the electrodes is observed.

The phthalaldehyde acetals obtainable by the process of the invention are intermediates, for example for the preparation of dyes and optical brighteners, and they are also used for the synthesis of special polymers.

EXAMPLE 1

Electrochemical synthesis of terephthaldialdehyde tetrmethylacetal

Apparatus: unpartitioned flow-through cell containing 9 graphite electrodes

Anode: graphite

Electrolyte:

263 g of 1,4-bis-(methoxymethyl)-benzene, 13.2 g of sulfuric acid and 2370 g of methanol Cathode: graphite Electrolysis with 8.3 F per mole of 1,4-bis-(methoxymethyl)-benzene Current density: 3.3 A/dm$^2$ Temperature: 22°–25° C.

During electrolysis under the stated conditions, the electrolyte was pumped through the cell at a rate of 200 l/h, via a heat exchanger. When electrolysis was complete, the resulting mixture was neutralized with sodium methylate, after which methanol was distilled off at 65°–75° C. under atmospheric pressure, and the precipitated salt was separated off at 60°–70° C., via a pressure filter. The residue was purified by distillation at 100°–120° C. under 3 mbar, 3.5 g of 1,4-bis-(methoxymethyl)-benzene and 222.2 g of terephthaldialdehyde tetramethylacetal being obtained. This corresponds to a conversion of 98.7%, based on 1,4-bis-(methoxymethyl)-benzene, a yield of terephthaldialdehyde tetramethylacetal of 62.1%, and a selectivity of 62.9% with respect to terephthaldialdehyde tetramethylacetal. The 1,4-bis-(methoxymethyl)-benzene recovered was reused for electrolysis.

EXAMPLE 2

Electrochemical synthesis of terephthaldialdehyde tetramethylacetal

Apparatus: unpartitioned flow-through cell containing 9 graphite electrodes
Anode: graphite
Electrolyte:
145 g 1,4-bis-(methoxymethyl)-benzene,
20 g of potassium benzenesulfonate and
2370 g of methanol
Cathode: graphite
Electrolysis with 8.5 F per mole of 1,4-bis-(methoxymethyl)-benzene
Current density: 3.3 A/dm$^2$
Temperature: 23°–25° C.

During electrolysis under the stated conditions, the the electrolyte was pumped through the cell at a rate of 200 l/h, via a heat exchanger. The mixture obtained after electrolysis was worked up as described in Example 1, but without the addition of sodium methylate. The working up procedure gave 0.4 g of 1,4-bis-(methoxymethyl)benzene and 158.2 g of terephthaldialdehyde tetramethylacetal. This corresponds to a conversion of 99.7%, based on 1,4-bis-(methoxymethyl)-benzene, a yield of terephthaldialdehyde tetramethylacetal of 80.1%, and a selectivity of 80.4% with respect to terephthaldialdehyde tetramethylacetal. The potassium benzenesulfonate and methanol recovered were reused for electrolysis.

EXAMPLE 3

Electrochemical synthesis of o-phthaldialdehyde tetramethylacetal

Apparatus: unpartitioned flow-through cell containing 9 graphite electrodes
Anode: graphite
Electrolyte:
263 g of 1,2-bis-(methoxymethyl)-benzene,
20 g of potassium benzenesulfonate and
2370 g of methanol
Cathode: graphite
Electrolysis with 8.5 F per mole of 1,2-bis-(methoxymethyl)-benzene
Current density: 3.3 A/dm$^2$
Temperature: 28°–30° C.

During electrolysis under the stated conditions, the electrolyte was pumped through the cell at a rate of 200 1 /h, via a heat ex-changer. When electrolysis was complete, methanol was distilled off from the resulting mixture, under atmos-pheric pressure and at 65°–80° C. The precipitated potassium benzenesulfonate was separated off via a pres-sure filter, and the filtrate was subjected to frac-tional distillation at 100°–120° C. and under 5 mbar, 3.8 g of 1,2-bis-(methoxymethyl)-benzene and 230.3 g of o-phthaldialdehyde tetramethylacetal being obtained. This corresponds to a conversion of 98.6%, based on 1,2-bis-(methoxymethyl)-benzene, a yield of o-phthaldialde-hyde tetramethylacetal of 64.3%, and a selectivity of 65.3% with respect to o-phthaldialdehyde tetramethyl-acetal. The methanol and potassium benzenesulfonate recovered were reused for electrolysis.

I claim:

1. A process for the preparation of a phthalaldehye acetal of the formula

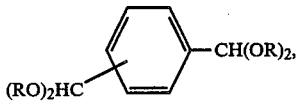

I where R is alkyl of 1 to 4 carbon atoms, wherein an alkoxymethylbenzene of the formula

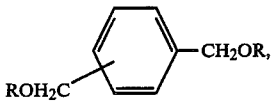

II is electrolyzed in the presence of an alkanol of the formula ROH, where R has the above meaning, at a current density of from 0.1 to 20 A/dm$^2$ and at a temperature which is not less than 5° C. below the boiling point of the alkanol.

2. A process as claimed in claim 1, wherein the electrolysis is carried out in an unpartitioned flow-through cell.

3. A process as claimed in claim 1, wherein the electrolyte used is composed of from 2 to 30% by weight of a bis-(alkoxymethyl)-benzene, from 65 to 98% by weight of an alkanol and from 0.1 to 5% by weight of an auxiliary electrolyte.

4. A process as claimed in claim 3, wherein the auxiliary electrolyte used is KF, $KSO_3C_6H_5$, $H_2SO_4$, $CH_3SO_3H$ or $C_6H_5SO_3H$.

* * * * *